US006991320B1

(12) United States Patent
Silverbrook

(10) Patent No.: US 6,991,320 B1
(45) Date of Patent: Jan. 31, 2006

(54) VENT IN A MICRO ELECTRO-MECHANICAL DEVICE

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/575,127

(22) Filed: May 23, 2000

(30) Foreign Application Priority Data

Jun. 30, 1999 (AU) ..... PO 1311

(51) Int. Cl.
*B41J 2/04* (2006.01)

(52) U.S. Cl. ..... 347/54

(58) Field of Classification Search ..... 347/54, 347/68, 69, 70, 71, 72, 50, 40, 47, 56, 9, 347/20, 29, 32, 44, 27, 84–86, 92; 399/261; 361/700; 310/328–330; 29/890.1; 251/129.01; 216/27

See application file for complete search history.

(56) References Cited

U.S. PATENT DOCUMENTS

| | | | |
|---|---|---|---|
| 4,356,499 | A | 10/1982 | Kodama |
| 4,745,414 | A | 5/1988 | Okamura |
| 5,649,423 | A | 7/1997 | Sniegowski |

FOREIGN PATENT DOCUMENTS

| | | |
|---|---|---|
| EP | 0529880 | 3/1993 |
| GB | 2332173 1 | 6/1999 |

*Primary Examiner*—Raquel Yvette Gordon

(57) ABSTRACT

A micro electro-mechanical device embodied within an ink ejection nozzle having an actuating arm that is caused to move an ink displacing paddle when heat inducing electric current is passed through the actuating arm is disclosed. The paddle is located in an ink chamber and the actuating arm passes through an actuator aperture in the chamber. The actuating arm including the paddle is moved to eject a droplet. The chamber includes a plurality of vents for venting to atmosphere air bubbles which may form in the chamber when the device operates to eject droplets of ink.

6 Claims, 4 Drawing Sheets

VENT IN A MICRO ELECTRO-MECHANICAL DEVICE

FIELD OF THE INVENTION

This invention relates to a vent within a micro electro-mechanical (MEM) device. The invention has application in ejection nozzles of the type that are fabricated by integrating the technologies applicable to micro electro-mechanical systems (MEMS) and complimentary metal-oxide semiconductor ("CMOS") integrated circuits, and the invention is hereinafter described in the context of that application. However, it will be understood that the invention does have broader application to vents within other types of MEM devices.

CO-PENDING APPLICATIONS

Various methods, systems and apparatus relating to the present invention are disclosed in the following co-pending applications filed by the applicant or assignee of the present invention simultaneously with the present application Ser. Nos.:

09/575,197, 09/575,197, 09/575,197, 09/575,197, 09/575,197, 09/575,148, 09/575,130, 09/575,165, 09/575,153, 09/575,118, 09/575,131, 09/575,116, 09/575,144, 09/575,139, 09/575,186, 09/575,185, 09/575,191, 09/575,145, 09/575,192, 09/609,303, 09/610,095, 09/575,596, 09/575,181, 09/575,193, 09/575,156, 09/575,183, 09/575,160, 09/575,150, 09/575,169, 09/575,184, 09/575,128, 09/575,180, 09/575,149, 09/575,179, 09/575,187, 09/575,155, 09/575,133, 09/575,143, 09/575,196, 09/575,198, 09/575,178, 09/575,164, 09/575,146, 09/608,920, 09/575,174, 09/575,163, 09/575,168, 09/575,154, 09/575,129, 09/575,124, 09/575,188, 09/575,189, 09/575,162, 09/575,172, 09/575,170, 09/575,171, 09/575,161, 09/575,141, 09/575,125, 09/575,142, 09/575,140, 09/575,190, 09/575,138, 09/575,126, 09/575,127, 09/575,158, 09/575,117, 09/564,034, 09/575,147, 09/575,152, 09/575,176, 09/575,151, 09/575,177, 09/575,175, 09/575,115, 09/575,114, 09/575,113, 09/575,112, 09/575,111, 09/575,108, 09/575,109, 09/575,182, 09/575,173, 09/575,194, 09/575,136, 09/575,119, 09/575,135, 09/575,157, 09/575,166, 09/575,134, 09/575,121, 09/575,137, 09/575,167, 09/575,120, 09/575,122.

The disclosures of these co-pending applications are incorporated herein by reference.

BACKGROUND OF THE INVENTION

A high speed page width ink jet printer has recently been developed by the present applicant. This typically employs in the order of 51,200 ink jet nozzles to print on A4 sheet paper to provide photographic quality image printing at 1,600 dpi. In order to achieve the nozzle density, the nozzles are fabricated by integrating MEMS-CMOS technology and this context reference may be made to International Patent Application No. PCT/AU00/00338 lodged by the present Applicant and entitled "Thermal Actuator".

These high speed page width ink jet printers produce an image on a sheet by causing an actuator arm to move relative to a substrate by forming the actuating arm in part from an electrically resistive material and by applying a current to the arm to effect movement of the arm. The arm is connected to a paddle so that upon movement of the arm the paddle is moved to eject a droplet of ink onto the sheet. In order to eject the droplet ink the paddle extends into a nozzle chamber which has a nozzle aperture and movement of the paddle causes the droplet to be ejected from the nozzle aperture.

SUMMARY OF THE INVENTION

The present invention provides a micro electro-mechanical device comprising:

a fluid chamber for containing a fluid, an outlet aperture in the chamber for allowing exit of fluid from the chamber, an actuator for dispensing fluid from the chamber through the outlet aperture, and at least one vent in the chamber for venting to the exterior of the chamber air bubbles which form within the chamber.

PREFERRED FEATURES OF THE INVENTION

Preferably the actuator includes a paddle located within the chamber, the chamber including a peripheral wall, and the at least one vent is arranged within the peripheral wall adjacent a peripheral portion of the paddle.

Preferably a plurality of vents are arranged in the peripheral wall, the plurality of vents being disposed about the peripheral wall adjacent to peripheral portions of the paddle.

Preferably the vent is defined by a first layer and a second layer spaced apart from the first layer, a sacrificial layer being deposited between the first and second layers and the sacrificial layer being etched away to form the vent between the first and second layers.

Preferably the first and second layers have a raised section defined by a pair of shoulders, the sacrificial material being deposited on the raised section of the first layer so as to define a vent passage which forms said vent when the sacrificial material is etched away, the second layer being deposited on the sacrificial material and the portion of the second layer deposited on the sacrificial material having a pair of side walls and a roof which, with the first layer, define the vent passage of the vent.

Preferably the shoulders include apertures for preventing wicking of fluid from the shoulders onto a substrate.

BRIEF DESCRIPTION OF THE DRAWINGS

A preferred embodiment of the invention will be described, by way of example, with reference to the accompanying drawings in which.

DESCRIPTION OF THE PREFERRED EMBODIMENTS

Figure 1:
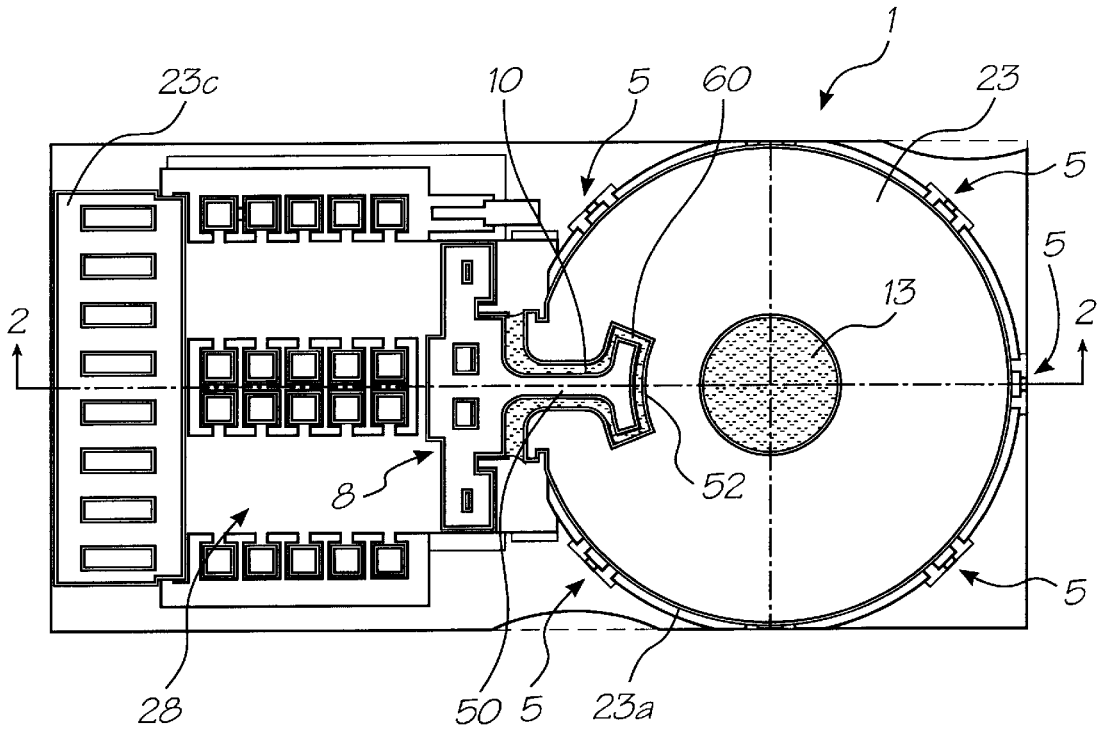
FIG. 1 is a plan view of one embodiment of the invention in an ink jet nozzle for a printer.

As illustrated with approximately 3000× magnification in FIG. 1, and other relevant drawing Figures, a single ink jet nozzle device 1 is shown as a portion of a chip which is fabricated by integrating MEMS and CMOS technologies. The complete nozzle device includes a support structure having a silicon substrate 20, a metal oxide semiconductor layer 21, a passivation layer 22, and a non-corrosive dielectric coating/chamber defining layer 29. Reference may be made to the above identified International Patent Application No. PCT/AU00/0038 for disclosure of the fabrication of the nozzle device. Operation of the device is also more fully disclosed in co-pending application entitled "Movement Sensor In A Micro Electro-mechanical Device" (Reference: MJ12) by the same Applicant. The contents of these two applications are incorporated into this specification by this reference.

The nozzle device incorporates an ink chamber 24 which is connected to a source (not shown) of ink. The layer 29 forms, amongst other components as will be described hereinafter, a chamber wall 23 which has a nozzle aperture 13 for the ejection of a droplet from ink 25 contained within the chamber 24. As best shown in FIG. 1 the wall 23 is generally cylindrical in configuration with the aperture 13 being provided substantially in the middle of the cylindrical wall 23. The wall 23 has a straight edge portion 10 which forms part of the periphery of the wall 23.

Figure 3:
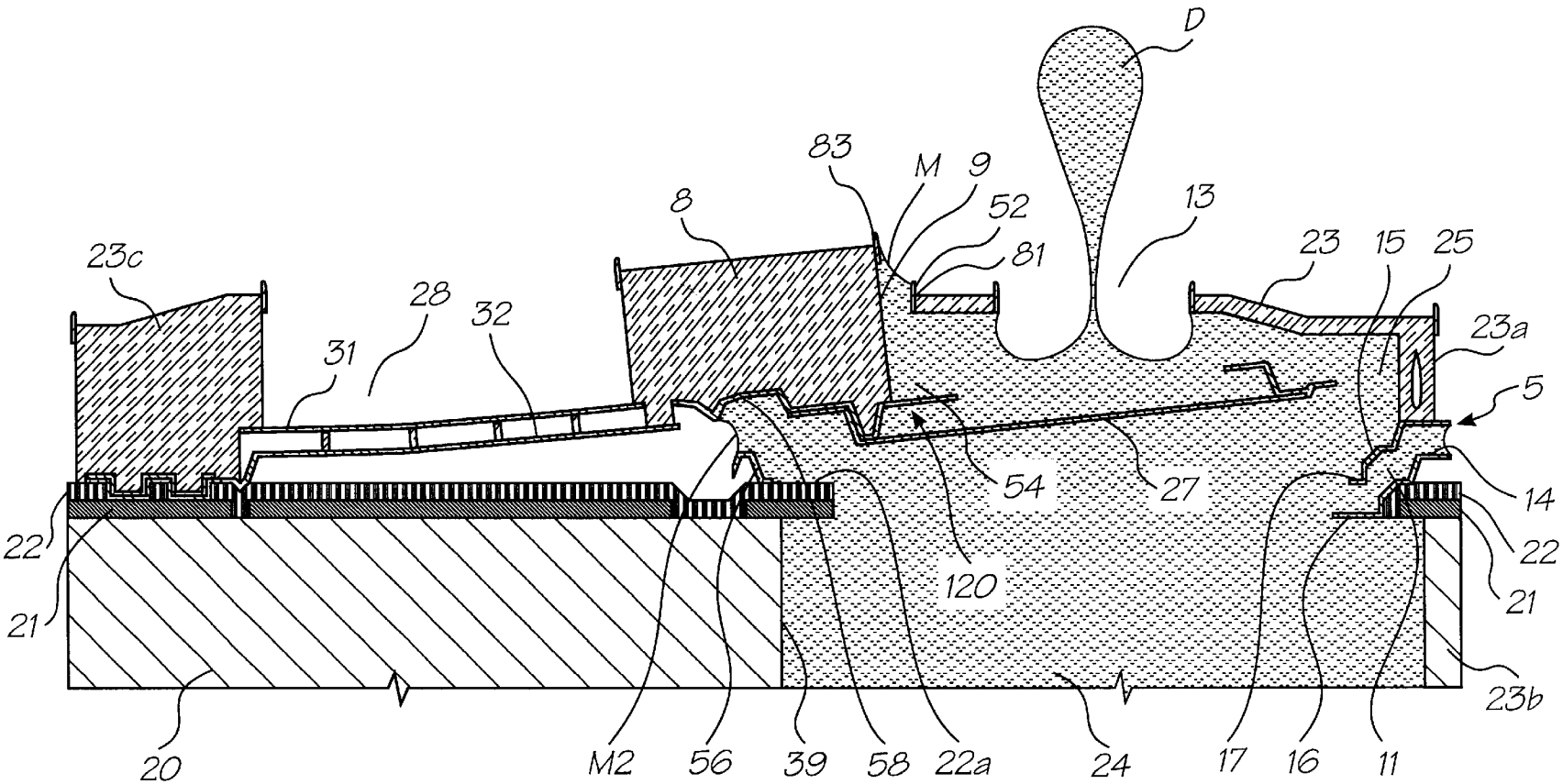
FIG. 3 is a more detailed cross-sectional view similar to FIG. 2 of the preferred embodiment of the invention in an extreme actuated position showing a drop being ejected from the nozzle.

As best seen in FIG. 3, the chamber 24 is also defined by a peripheral side wall 23*a*, a lower side wall 23*b*, a base wall (not shown), and by an edge portion 39 of substrate 20. An actuating arm 28 is formed on layer 22 and support portion 23*c* is formed at one end of the actuating arm 28.

The actuating arm 28 is deposited during fabrication of the device and is pivotable with respect to the substrate 20 and support 23*c*. The actuating arm 28 comprises upper and lower arm portions 31 and 32. Lower portion 32 of the arm 28 is an electrical contact with the CMOS layer 21 for the supply of electrical current to the portion 32 to cause movement of the arm 28, by thermal bending, from the position shown in FIG. 2 to the position shown in FIG. 3 so as to eject droplet D through aperture 13 for deposition on a sheet (not shown). The layer 22 therefore includes the power supply circuitry for supplying current to the portion 32 together with other circuitry for operating the nozzle shown in the drawings as described in the aforesaid co-pending applications.

A block 8 is mounted on the actuator arm 28. The block 8 includes a generally T-shaped portion 50 (when viewed in plan) which has a peripheral wall 10. The upper wall 23 of the chamber 24 has a generally T-shaped slot 60, defined by edge portion 52 of the wall 23, which receives the T-shaped portion 50 of the block 8. The actuator 28 carries a paddle 27 which is arranged within the chamber 24 and which is moveable with the actuator as shown in FIGS. 1 and 3 to eject the droplet D.

The peripheral wall 23*a*, chamber wall 23, block 8 and support portion 23*c* are all formed by deposition of material which forms the layer 29 and by etching sacrificial material to define the chamber 24, nozzle aperture 13, the discrete block 8 and the space between the block 8 and the support portion 23*c*. The lower wall portion 23*b* is also formed during deposition with the substrate 20.

Figure 2:
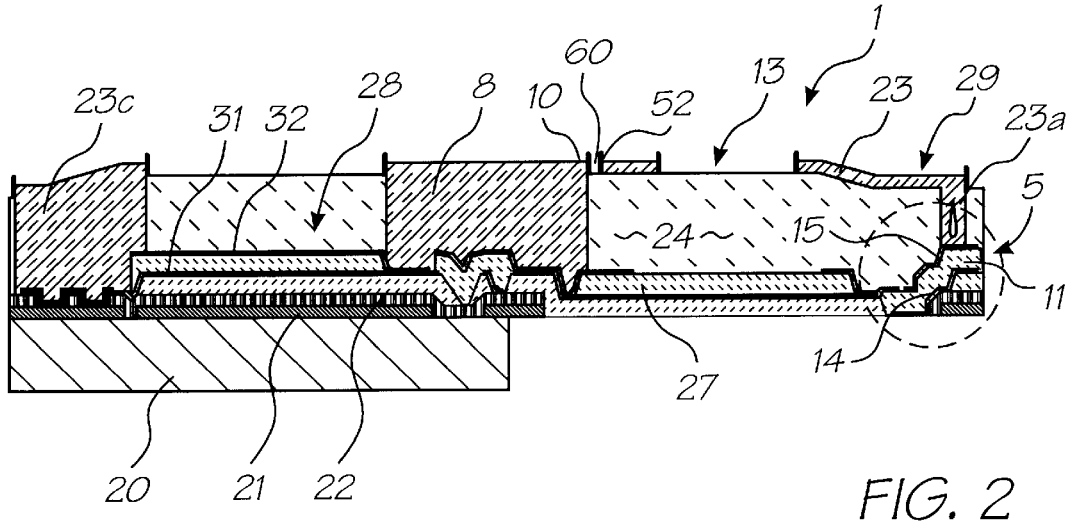
FIG. 2 is a cross-sectional view of the nozzle of FIG. 1 along line 2—2 of FIG. 1.

The space between end edge 22*a* of layer 22 and edge portion 50 of the wall 23 defines an actuator aperture 54 which is substantially entirely closed by T-shaped portion 50 of the block 8 when the actuator 28 is in a rest or quiescent state as shown in FIGS. 1 and 2. In the quiescent position shown in FIGS. 1 and 2, the wall 10 of the portion 50 is separated from the edge 52 by a distance of less than one micron so as to define a fine slot between the edge 57 and the wall 10.

As the actuator arm 28 moves up and down to eject droplet D from the chamber 24, the block 8 and wall 10 move up and down relative to edge 52 of slot 60 of the wall 23 whilst maintaining a closely spaced apart relationship with the edge 52 of the wall 23. A meniscus M is formed between the wall 10 and the edge 52 as the wall 10 moves up and down relative to the edge 52 in view of the close proximity of the wall 10 to the edge 52. The maintenance of the meniscus M, forms a seal between edge 52 and wall 10, and therefore reduces opportunities for ink leakage and wicking from chamber 24. A meniscus M2 is also formed between support flange 56 formed on the layer 22 and portion 58 of the actuator 28 on which block 8 is formed. When in the quiescent position the portion 58 rests on the flange 54. The formation of the meniscus M2 also reduces opportunities for ink leakage and wicking during movement of the actuating arm 28 and the paddle 27. A meniscus (not shown) is also formed between the sides (not shown) of actuator aperture 54 and the edges (not shown) of wall 23*a* which define the aperture 54.

As shown in FIG. 3, the edge portion 52 may carry a lip 81 and the wall 10 may also carry a lip 83 to further reduce the likelihood of wicking of ink from the chamber 24 onto the block 8 or upper surface of the wall 23. The lip 81 may extend completely about the periphery of the wall 23 and similar lips may also be provided on the aperture 13.

As shown in FIG. 1, a plurality of vents 5 are arranged in the peripheral wall 23*a* of the chamber 24. In the preferred embodiment, five vents 5 are included. The vents 5 are arranged adjacent to the periphery of paddle 27 (which is generally circular in configuration matching the configuration of the chamber 24) when the paddle 27 is in the quiescent position shown in FIG. 2.

Figure 4:
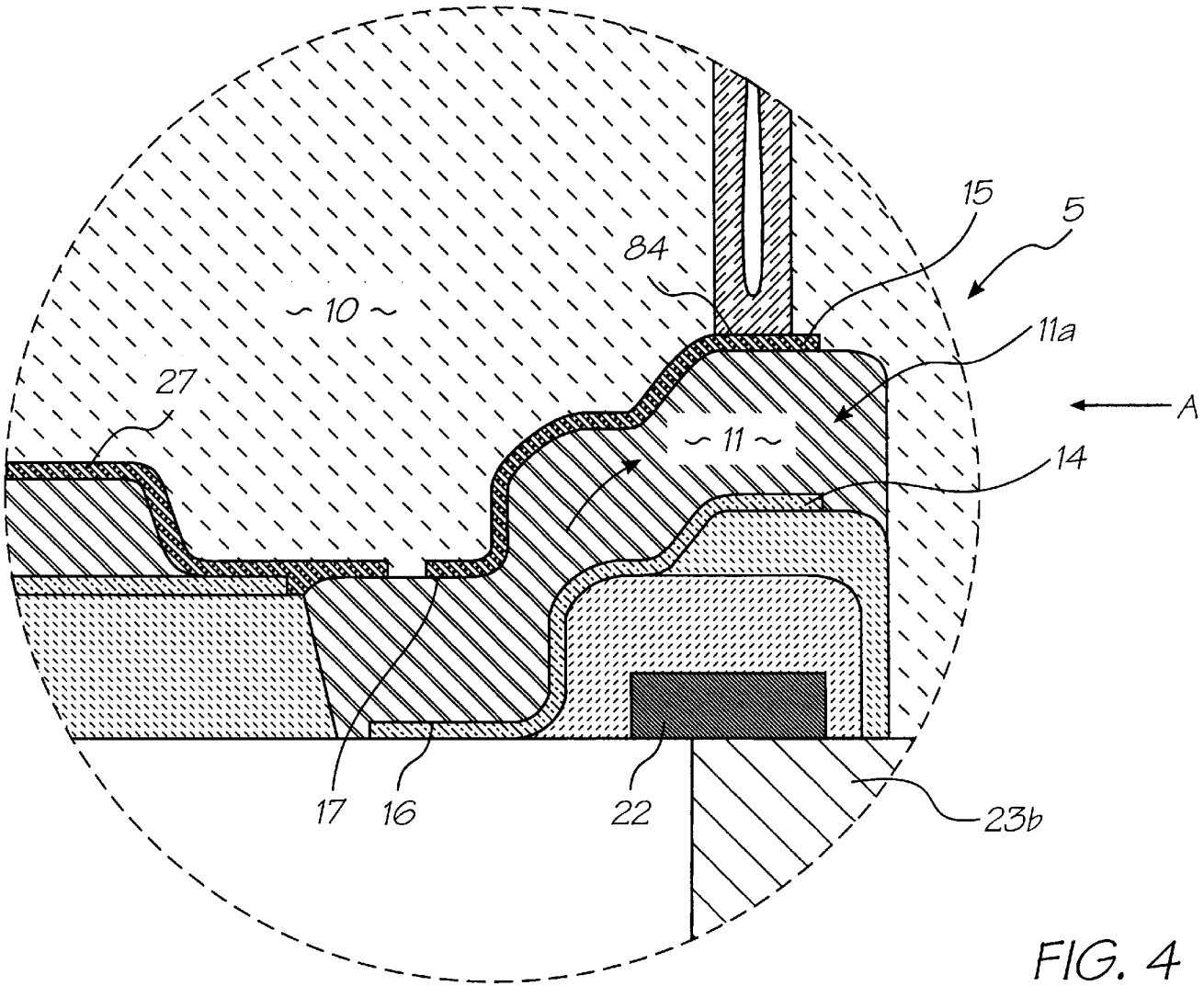
FIG. 4 is a detailed view of a portion of the preferred embodiment shown in FIGS. 1 to 3.
Figure 5:
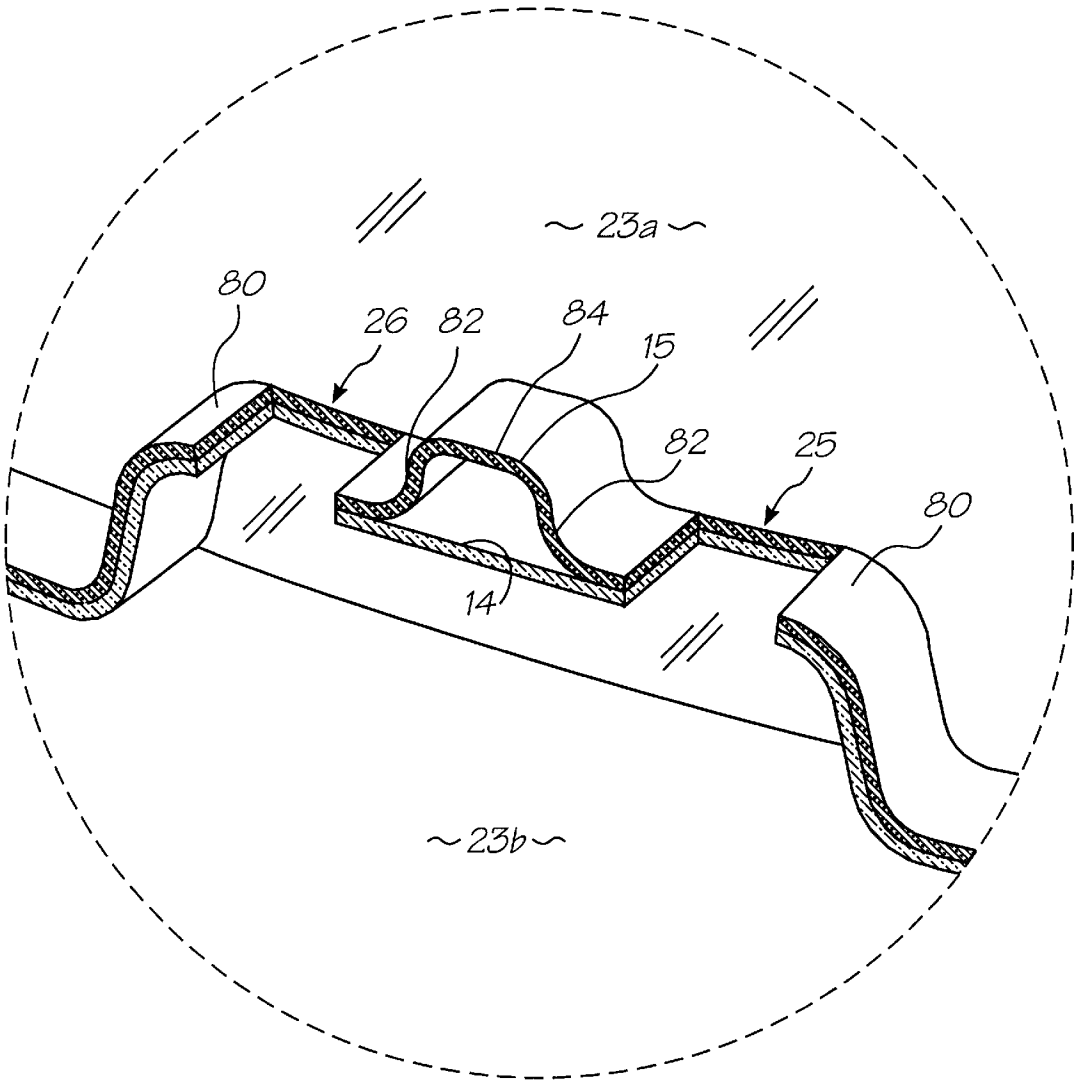
FIG. 5 is a view from the direction of arrow A in FIG. 4.

As shown in more detail in FIGS. 4 and 5, the vent 5 is formed by a first deposited titanium nitride layer 14 which includes a ledge portion 16, and a second titanium nitride layer 15 which has a ledge portion 17. In the formation of the nozzle shown in the drawings, a sacrificial material is despotised on the layer 14 onto which the layer 15 is then deposited and the sacrificial material is etched away to leave a vent passage 11 between the layers 14 and 15, which forms the vent 5, and which has an outlet opening 11*a*. The passage 11 communicates with the interior of the chamber 24.

As best shown in FIG. 5, the vent opening la is formed in a raised portion of the layers 14 and 15. The layers 14 and 15 are generally annular in configuration extending about the periphery of the chamber 24. The layers 14 and 15 are in contact with one another except at the positions where the vent passages 11 are formed. As best shown in FIG. 5, the layers 14 and 15 extend upwardly at the vents 5 to form shoulders 80. The portion of the layer 14 between the shoulders 80 is generally planar as shown in FIG. 5. However, the layer 15 diverges upwardly from the layer 14 to define walls 82 and a roof section 84 which with the layer 14 define the vent passage 11 and vent opening 11*a*. The sacrificial material is deposited generally to take the shape of the vent passage 11 so that the layer 15 is deposited on the layer 14 except for where the sacrificial material is located, and the layer 15 extends over the sacrificial material where the vent passage 11 is to be formed so as to form the side walls 82 and roof 84 shown in FIG. 5. As noted above, the sacrificial material is then etched away leaving the vent passage 11 between the layers 14, and 15.

The shoulders 80 are provided with slots 25 and 26 which prevent the possibility of any fluid which may leak from the chamber 24 through the vents 5 wicking along the lower surface of the layer 14 and reaching the layer 22 which may cause damage to the layer 22. In general, fluid is prevented from leaking out of the vents 5 by an ink meniscus which forms across the vent opening 11*a* between the layers 13 and 14 to thereby form a seal which reduces the likelihood of any ink leaking from the vents 5.

During the operation of the nozzle, when the paddle 27 moves from the quiescent position shown in FIGS. 1 and 2 to the position shown in FIG. 3 to eject a drop D of fluid, there is a possibility that bubbles may form particularly adjacent the ledges 16 and 17. Any bubbles which form will be able to pass through the vent passage 11 and out of the vent opening 11*a* of each vent 5 to expire to the external ambient atmosphere.

I claim:

1. A micro electro-mechanical device comprising:

a fluid chamber for containing a fluid, an outlet aperture in the chamber for allowing exit of fluid from the chamber, an actuator for dispensing fluid from the chamber through the outlet aperture, and at least one vent in the chamber for venting to the exterior of the chamber air bubbles which form within the chamber.

2. The device of claim 1 wherein the actuator includes a paddle located within the chamber, wherein the chamber includes a peripheral wall, and wherein the or, if more than one, vent is located within the peripheral wall adjacent a peripheral portion of the paddle.

3. The device of claim 2 wherein a plurality of vents is arranged in the peripheral wall, the plurality of vents being disposed about the peripheral wall adjacent to peripheral portion of the paddle.

4. The device of claim 1 wherein the vent is defined by a first layer and a second layer spaced apart from the first layer, a sacrificial layer being deposited between the first and second layers and the sacrificial layer being etched away to form the vent between the first and second layers.

5. The device of claim 4 wherein the first and second layers have a raised section defined by a pair of shoulders, the sacrificial material being deposited on the raised section of the first layer so as to define a vent passage which forms said vent when the sacrificial material is etched away, the second layer being deposited on the sacrificial material and the portion of the second layer deposited on the sacrificial material having a pair of side walls and a roof which, with the first layer, define the vent passage of the vent.

6. The device of claim 5 wherein the shoulders include apertures for preventing wicking of fluid from the shoulders onto a substrate.

* * * * *